US005609085A

United States Patent [19]

Chang

[11] Patent Number: 5,609,085

[45] Date of Patent: Mar. 11, 1997

[54] CUTTING DEVICE WITH A PIVOTABLE COVER FOR COVERING AN EXPOSED CUTTING PORTION

[75] Inventor: Chiu-Tsun Chang, Taichung, Taiwan

[73] Assignee: P & F Brother Industrial Corporation, Taiwan

[21] Appl. No.: 397,367

[22] Filed: Mar. 2, 1995

[51] Int. Cl.[6] ..... B27B 5/18

[52] U.S. Cl. ..... 83/397; 83/478; 83/490

[58] Field of Search ..... 83/490, 478, 397, 83/471.3, 581, DIG. 1

[56] References Cited

U.S. PATENT DOCUMENTS

| | | | |
|---|---|---|---|
| 4,799,416 | 1/1989 | Kumasaka et al. | 83/397 |
| 5,046,390 | 9/1991 | Sasaki | 83/490 |
| 5,146,825 | 9/1992 | Dehari | 83/397 |
| 5,203,245 | 4/1993 | Terpstra | 83/490 |
| 5,370,025 | 12/1994 | Itzov | 83/397 |

*Primary Examiner*—Rinaldi I. Rada
*Assistant Examiner*—Allan M. Schrock
*Attorney, Agent, or Firm*—Cushman Darby & Cushman Intellectual Property Group of Pillsbury Madison & Sutro, L.L.P.

[57] ABSTRACT

A cutting device includes a bench with an upright post, and a carrier mounted swingably to the upright post. The carrier has a mounting shaft with a circular cutting tool mounted rotatably thereon, an opening through which a portion of the cutting tool is exposed, and a cover member mounted pivotally to the mounting shaft and pivotable thereabout between a first position, wherein the cover member is exposed from the carrier via the opening to enclose the exposed portion of the circular saw, and a second position, wherein the cover member is disposed in the carrier to uncover the exposed portion of the cutting tool. The carrier further has a moving unit for pivoting the cover member between the first and second positions.

2 Claims, 4 Drawing Sheets

CUTTING DEVICE WITH A PIVOTABLE COVER FOR COVERING AN EXPOSED CUTTING PORTION

BACKGROUND OF THE INVENTION

1. Field of the Invention

The invention relates to a cutting device, more particularly to a cutting device with a carrier which has a pivotable cover member that exposes a cutting portion of a circular cutting tool only when in a cutting operation and that encloses the cutting portion of the circular cutting tool when the cutting device is not in use.

2. Description of the Related Art

FIG. 1 shows a conventional cutting device which includes a bench 10 with an upright post 11, and a carrier 12 mounted swingably to the upright post 11 and biased to dispose the carrier 12 normally at an inclined condition relative to the bench 10. The carrier 12 has a mounting shaft (not shown) with a circular cutting tool 13 mounted rotatably thereon, an opening 14 through which a portion of the circular cutting tool 13 is exposed in order to cut off a workpiece, a motor 15 mounted on the carrier 12 for driving the circular cutting tool 13, and a handle 11 for pivoting the carrier 12 in order to move the exposed portion of the circular cutting tool 13 for performing a cutting operation.

A main drawback of the conventional cutting device is as follows: since the carrier does not have a cover member for covering the exposed portion of the circular cutting tool when the conventional cutting device is not in use, the exposed portion of the circular cutting tool may injure a person in the event, the person accidentally touches the exposed portion of the cutting tool.

SUMMARY OF THE INVENTION

The main object of the present invention is to provide a cutting device which includes a carrier with a pivotable cover member that encloses a cutting portion of a circular cutting tool so as to cover the latter when the cutting device is not in use.

Accordingly, a cutting device of the present invention includes a bench with an upright post, and a carrier mounted swingably to the upright post and biased to dispose the carrier normally at an inclined position with respect to the bench. The carrier has a mounting shaft with a circular cutting tool mounted rotatably thereon, an opening through which a portion of the cutting tool is exposed, and a motor for driving the cutting tool. The carrier further has a substantially semi-circular cover member mounted pivotally to the mounting shaft and pivotable relative to the mounting shaft between a first position, wherein the semi-circular cover member is exposed from the carrier through the opening to enclose the exposed portion of the cutting tool, and a second position, wherein the semi-circular cover member is disposed in the carrier to uncover the exposed portion of the cutting tool. The carrier further has means for moving the semi-circular cover member between the first and second positions.

In the disclosed embodiment, the semi-circular cover member has a guiding flange formed integrally therewith. The moving means includes a pivot pin mounted in the carrier and spaced from the mounting shaft in a parallel manner and located closer to the upright post when compared to the mounting shaft, an elongated rod provided within the carrier transverse to the mounting shaft and having a first end connected pivotally to the upright post, and a crank with two ends and an angular portion between the two ends. One end of the crank is connected pivotally to the pivot pin. The other end of the crank engages and is movable along the guiding flange of the cover member. The angular portion of the crank is connected pivotally to a second end of the elongated rod. Thus, the semi-circular cover member is retainable at the first position. The carrier further includes a press roller fixed rotatably therein for compressing the elongated rod at a position between the first and second ends when the carrier is pivoted relative to the upright post so as to move towards the bench. The circular cutting tool is preferably a cutting wheel or a circular saw disc.

Since the cover member employed in the cutting device of the present invention encloses and thus covers the exposed portion of the circular cutting tool when the cutting device is not in use, the likelihood of injury to a person by the exposed portion of the cutting tool is eliminated.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
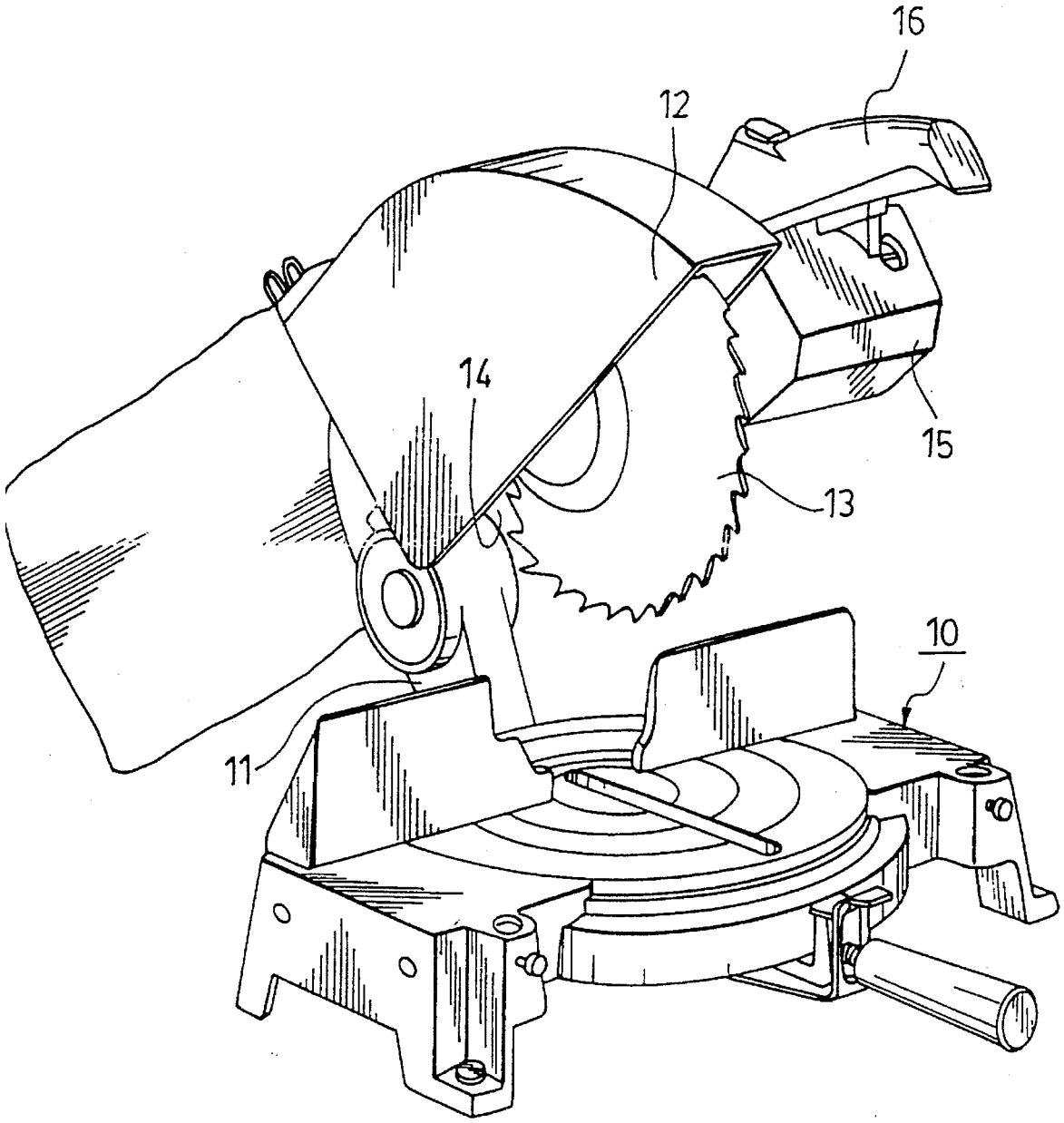
FIG.1 PRIOR ART
FIG. 1 is a perspective view of a conventional cutting device.
Figure 2:
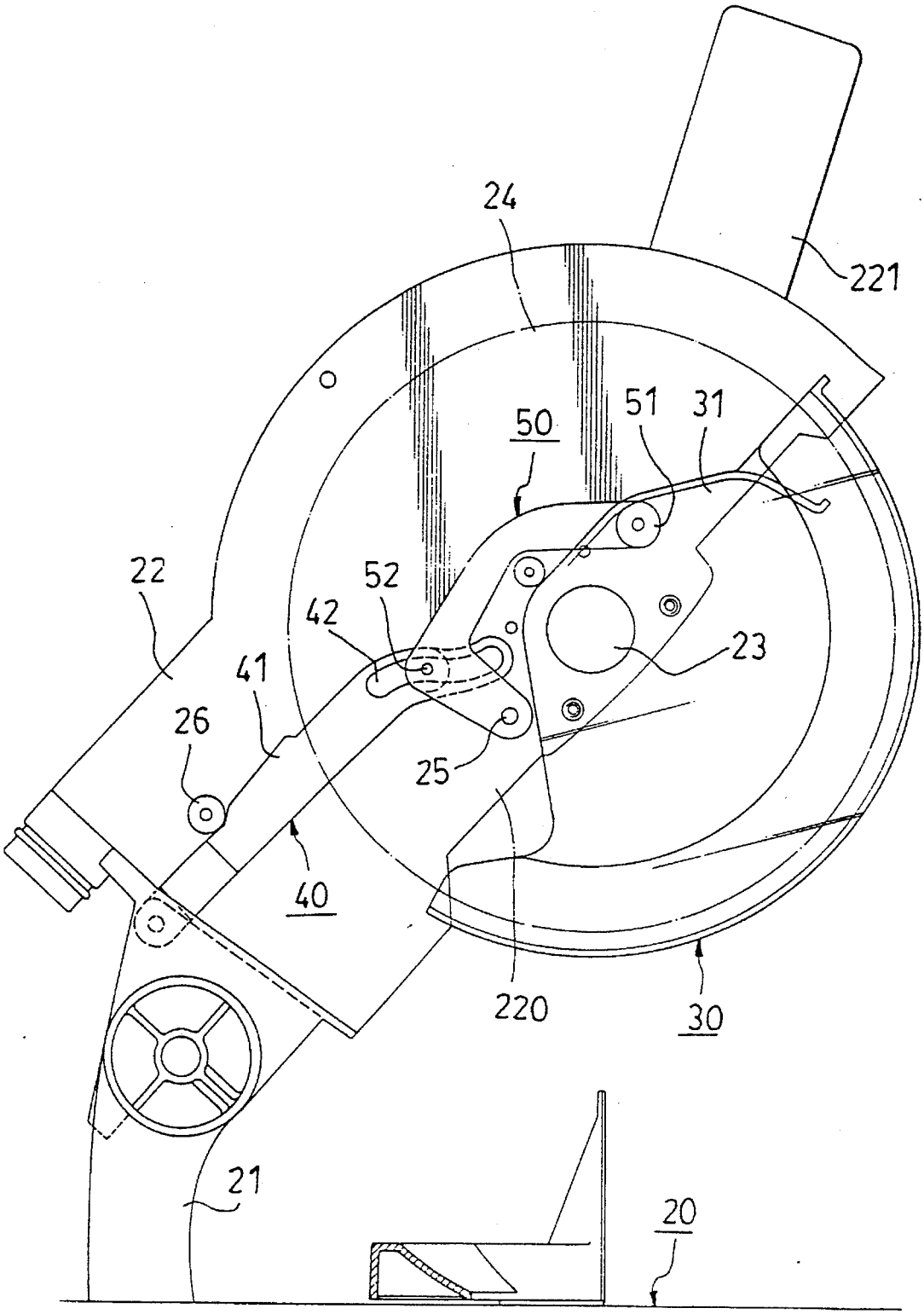
FIG. 2 is a side view of a cutting device of the present invention at a normal condition, illustrating the circular cutting tool when enclosed by a pivotable cover member.

Referring to FIG. 2, a cutting device of the present invention, such as an electric sawing machine, is shown to comprise a bench 20 with an upright post 21 and a carrier 22 mounted swingably to an upper portion of the upright post 21 and biased to dispose the carrier 22 normally at an inclined position with respect to the bench 20.

The carrier 22 is made of a transparent material in order to permit viewing of an interior of the same and has a mounting shaft 23 with a circular cutting tool 24, such as a circular saw disc, mounted rotatably thereon, an opening 220 through which a portion of the circular cutting tool 24 is exposed, and a motor (not shown) mounted on the carrier 22 and which having a driving shaft connected axially to the mounting shaft 23 for driving the saw 24. The carrier 22 is provided with an operating handle 221 which extends from the carrier 22 for swinging the latter in order to move the circular cutting tool 24 toward and away from the bench 20.

Figure 3:
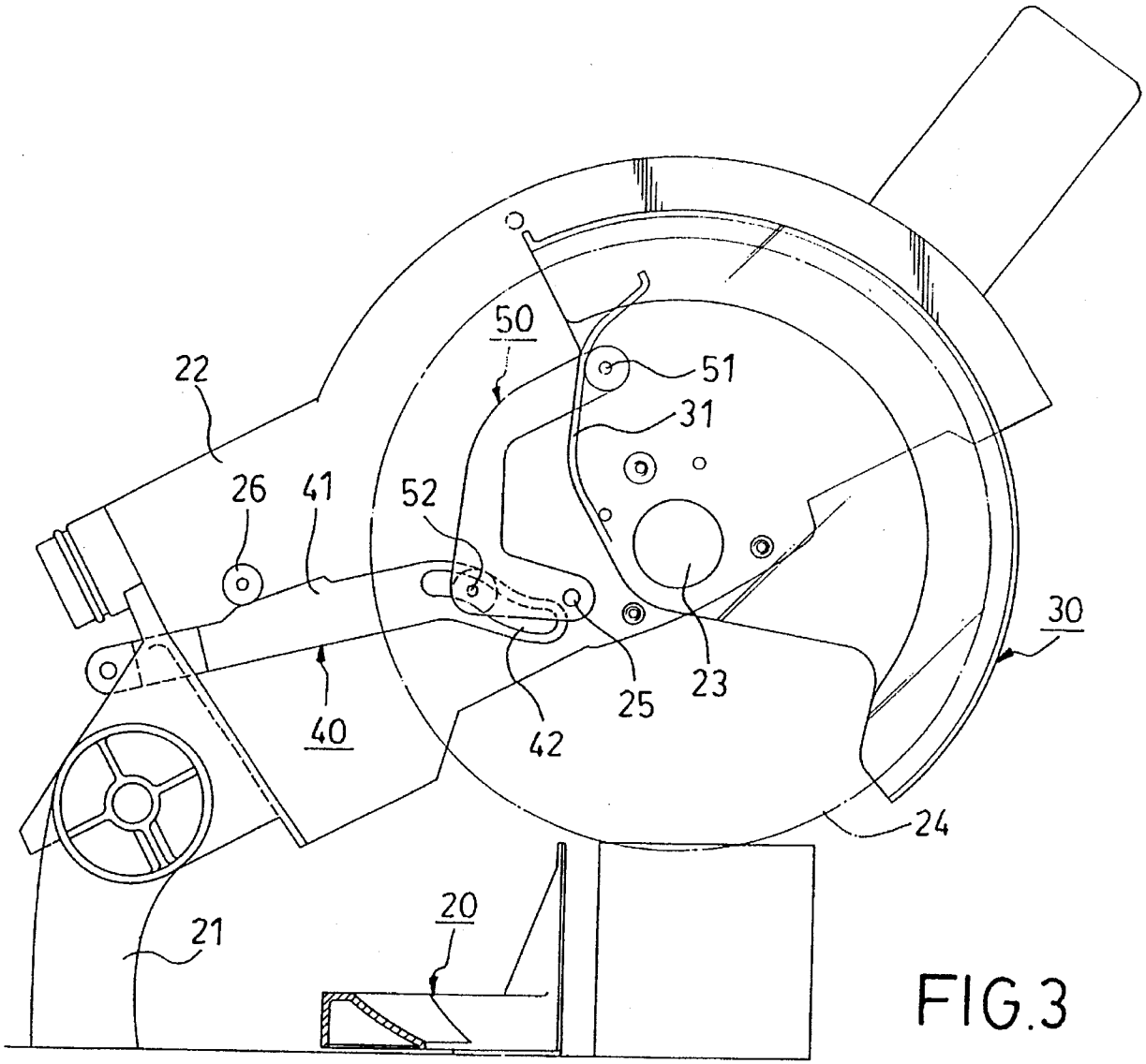
FIG. 3 is a side view of the cutting device of the present invention in operation, illustrating how the pivotable cover member exposes a portion of the circular cutting tool.
Figure 4:
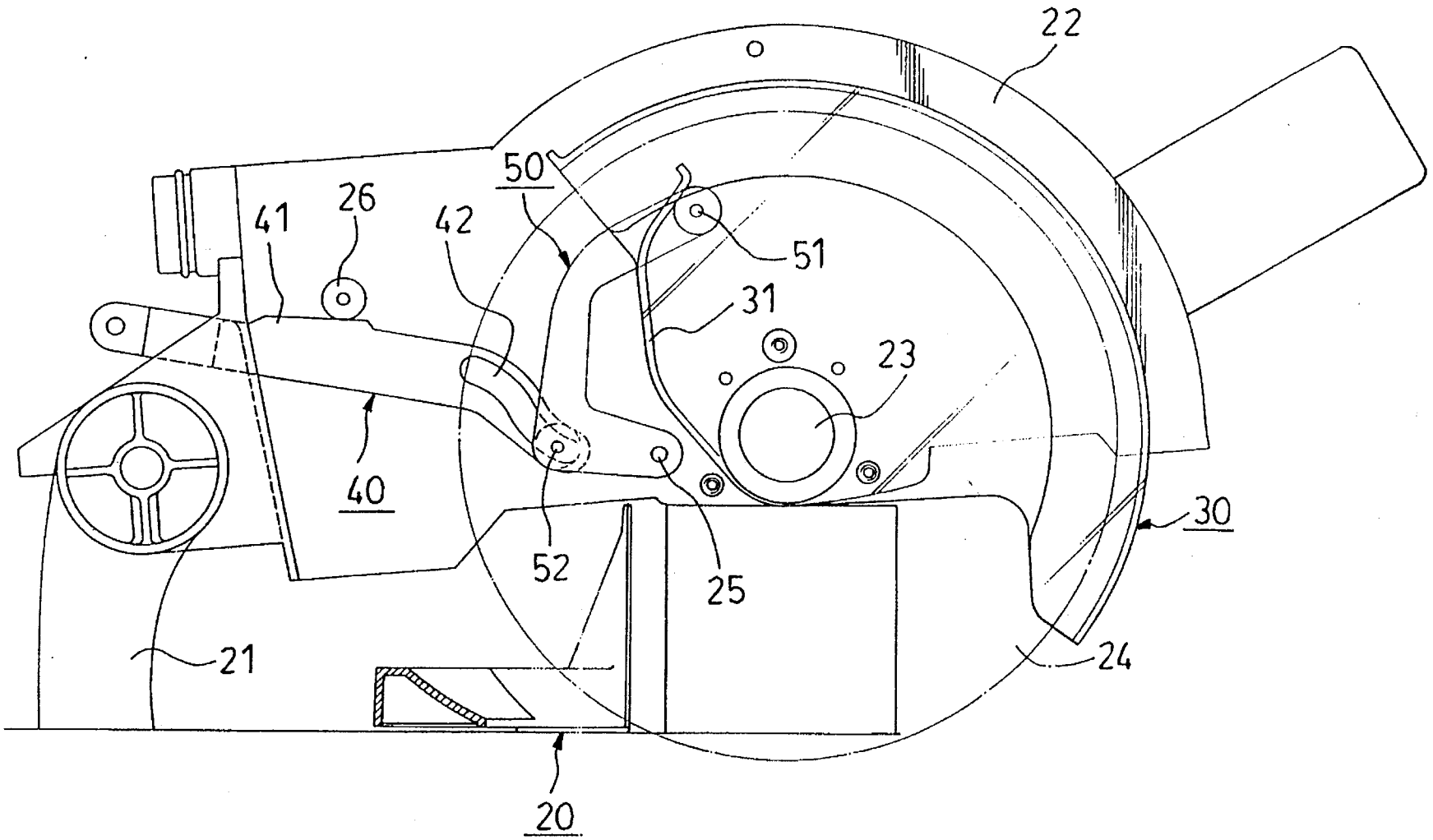
FIG. 4 is a side view of the cutting device of the present invention in operation, illustrating the pivotable cover member when exposing a larger portion of the circular cutting tool from the carrier.

The cutting device further comprises a substantially semi-circular cover member 30 made of a transparent material and having a guiding flange 31 formed integrally therewith. The cover member 30 is mounted pivotally to the mounting shaft 23 and is pivotable relative thereto between a first position, wherein the cover member 30 is exposed from the carrier 22 through the opening 220 to enclose the exposed portion of the circular cutting tool 24, as shown in FIG. 2, and a second position, wherein the cover member 30 is disposed in the carrier 22, as shown in FIGS. 3 and 4, to uncover the exposed portion of the circular cutting tool 24 during the cutting operation of a workpiece.

The cover member 30 is moved between the first and second positions by a moving means 40 mounted within the carrier 22. The moving means 40 includes a pivot pin 25 mounted within the carrier 22 and spaced from the mounting shaft 23 in a parallel manner and located closer to the upright post 21 when compare to the mounting shaft 23, and an elongated rod 41 provided within the carrier 22 transverse to the mounting shaft 23 and having a first end connected pivotally to the upper portion of the upright post 21. The moving means 40 further includes a substantially U-shaped crank 50 with two ends and an angular portion between the two ends. One of the ends of the crank 50 is connected pivotally to the pivot pin 25. The other end of the crank 50 is provided with a roller 51 which engages the guiding flange 31 of the cover member 30 and which is movable therealong. The angular portion of the crank 50 is connected pivotally to a second end of the elongated rod 41. Thus, the angular portion of the crank 50 is suspended movably by the elongated rod 41 to retain the cover member 30 at the first position. The carrier 22 is further provided with a press roller 26 fixed rotatably therein for compressing the elongated rod 41 at a position between the first and second ends when the carrier 22 is pivoted relative to the upright post 21 so as to move the carrier 22, thus moving the circular cutting tool 24 towards the bench 20.

When the carrier 22 is pivoted by actuating of the handle 221, the press roller 26 depresses the elongated rod 41 to cause pivoting of the latter, thereby urging the angular portion of the crank 50 to pivot about the pivot pin 25 and consequently cause the cover member 30 to pivot about the mounting shaft 23 so as to dispose the cover member 30 at the second position.

Note that in order to facilitate pivotal connection between the elongated rod 41 and the crank 50, the angular portion of the crank 50 is provided with a roller 52 while the elongated rod 41 is provided with an axial slot 42 formed therethrough adjacent to the second end to receive engageably and movably the roller 52 therein. Thus, during the pivotal action of the crank 50 relative to the pivot pin 25, the roller 52 of the crank 50 moves slightly within the axial slot 42 of the elongated rod 41 so that a jamming between the elongated rod 41 and the crank 50 will not occur when swinging the carrier 22 relative to the bench 20.

As to how much of the cover member 30 swings relative to the mounting shaft 23 so as to dispose the cover member 30 within the carrier 22 to expose the circular cutting tool 24 from the carrier 22 during the cutting operation can be arranged by known art, and therefore will not be detailed herein.

Since the cover member attached to the carrier of the cutting device of the present invention encloses and thus covers the exposed portion of the circular cutting tool of the carrier when the cutting device is not in use, the likelihood of injury to a person by the cutting tool is eliminated.

With the present invention thus explained, it is obvious to those skilled in the art that various modifications and variations can be made without departing from the scope and spirit thereof. Therefore, this invention should be limited only as in the appended claims.

I claim:

1. A cutting device including a bench with an upright post, and a carrier mounted swingably to said upright post and biased to dispose said carrier normally at an inclined position with respect to said bench, said carrier having a horizontal mounting shaft with a circular cutting tool mounted rotatably thereon, an opening through which a cutting portion of the cutting tool is exposed, and a motor for driving said circular cutting tool, wherein said cutting tool further comprises:

a substantially semi-circular cover member mounted pivotally to said mounting shaft and pivotable relative to said mounting shaft between a first position, wherein said semi-circular cover member covers said cutting portion of said circular cutting tool, and a second position, wherein said cutting portion of said cutting tool is uncovered by said cover member; and means for moving said semi-circular cover member between said first and second positions including a guiding flange integrally formed on an inner surface of said cover member, a pivot pin parallel to and spaced from said mounting shaft and located closer to said upright post than said mounting shaft, an elongated rod provided within the carrier transverse to said mounting shaft and having an end portion connected pivotally to said upright post, and a crank having a first end connected pivotally to said pivot pin, a second end connected slidably to said guiding flange, and an angular portion which is formed between said first and second ends and which is connected pivotally to an other end portion of said elongated rod in order to retain said cover member at said first position, said carrier further including a press roller mounted rotatably therein for pressing said elongated rod when said carrier is pivoted relative to said bench;

pivoting action of said carrier relative to said bench enables said press roller to depress said elongated rod, thereby urging said angular portion of said crank to pivot about said pivot pin so as to move said cover member to said second position.

2. The cutting device as defined in claim 1, wherein said angular portion of said crank has a roller extending therefrom, the other end portion of said elongated rod having an elongated slot formed therein to receive said roller such that said roller can rotate in said slot.

* * * * *